US005743621A

United States Patent [19]

Mantha et al.

[11] Patent Number: 5,743,621

[45] Date of Patent: Apr. 28, 1998

[54] ILLUMINATED SAFETY HELMET

[76] Inventors: Robert L. Mantha, 1657 Lesperance Road, Sandwich South, Ontario, N8N 142, Canada; Robert Colaizzi, 106 Wilkinson Drive, Leamington, Ontario, Canada, N8H 3V5

[21] Appl. No.: 695,165

[22] Filed: Aug. 8, 1996

Related U.S. Application Data

[60] Provisional application No. 60/007,143, Nov. 1, 1995.

[51] Int. Cl. [6] ..... F21V 33/00

[52] U.S. Cl. ..... 362/105; 362/184; 362/800; 362/394

[58] Field of Search ..... 362/103, 105, 362/106, 108, 190, 191, 184, 249, 800, 155, 806, 295, 394

[56] References Cited

U.S. PATENT DOCUMENTS

| | | | |
|---|---|---|---|
| 4,559,586 | 12/1985 | Slarve | 362/106 |
| 4,760,373 | 7/1988 | Reilly . | |
| 4,891,736 | 1/1990 | Gouda | 362/105 |
| 4,956,752 | 9/1990 | Foglietti . | |
| 5,151,678 | 9/1992 | Veltri et al. | 362/103 |
| 5,183,324 | 2/1993 | Thomas | 362/105 |
| 5,327,588 | 7/1994 | Garneau | 362/108 |
| 5,329,637 | 7/1994 | Walker | 362/106 |
| 5,357,409 | 10/1994 | Glatt | 362/105 |
| 5,408,393 | 4/1995 | Becker . | |
| 5,416,675 | 5/1995 | DeBeaux . | |
| 5,438,492 | 8/1995 | Collins et al. | 362/108 |

*Primary Examiner*—Thomas M. Sember

*Attorney, Agent, or Firm*—Reising, Ethington, Barnard & Perry

[57] ABSTRACT

An illuminated safety helmet includes a pair of LED modules that are mounted at the front and back of the helmet and arranged in an electrical circuit with an on-board battery. The helmet has a chin strap fitted with snap together connectors which when joined operator to secure the helmet on the user's head. A pair of electrical contacts are incorporated into the connectors and operate as a switch which closes and opens the circuit, respectively, with the engagement and disengagement of the connectors.

14 Claims, 3 Drawing Sheets

ILLUMINATED SAFETY HELMET

CROSS-REFERENCE TO RELATED APPLICATION

This application is based upon and claims priority to U.S. Provisional application Ser. No. 60/007,143 filed Nov. 1, 1995.

TECHNICAL FIELD

This invention relates to safety helmets for recreational and occupational activities and more particularly to illuminated safety helmets.

BACKGROUND OF THE INVENTION

Persons who engage in certain recreational or occupational activities such as bicycling, motorcycling, skateboarding, in-line skating, and construction work, often wear a safety helmet to provide protection against head injuries. In low light or poor visibility conditions, it is difficult for passing motorists to see the individual.

Various reflectors and lighting systems for safety helmets are in use or have been proposed in an effort to make the wearer more visible to others. Reflectors are limited in that they are passive devices that function only when subjected to an external source of illumination. Their effectiveness as a warning device may be limited by the brightness of the external illumination source and its angle of incidence upon the reflector.

Various illuminated safety helmets are known in the prior art. U.S. Pat. No. 5,327,588 for example, employs an illumination system comprising a light source, a battery, and a manual on/off switch that allows the wearer to turn on and off the light source as desired.

U.S. Pat. No. 5,416,675 discloses an illumination system for a safety helmet having an automatic on/off switch inside the helmet that operates by engaging the top of the wearer's head when the helmet is worn to activate the light. Some users, however may find or perceive discomfort with prolonged contact with such a switch and may discourage them from wearing the helmet altogether.

An illuminated safety helmet constructed in accordance with the present invention overcomes the foregoing objections.

SUMMARY OF THE INVENTION

An illuminated safety helmet constructed according to the invention comprises a protective helmet having a pair of fastening straps extending from opposite sides of the helmet. The straps carry releasably engageable buckle portions at their loose ends that, when connected, operate to secure the helmet releasably to the head of the user and when disconnected enable the helmet to be removed. The helmet includes a light source coupled to a battery source by a control circuit that is responsive to connecting and disconnecting the buckle portions to energize and de-energize, respectively, the light source.

According to a preferred feature, electrical contacts are provided in the buckle portions that when engaged, complete the circuit from the power source to the light source to energize the light source, and when disengaged open the circuit and de-energize the light source.

The incorporation of the on/off switch in the buckle portions of the straps advantageously couples the operation of the light source with the buckling and unbuckling of the straps, which is something the wearer must do any how in order to secure and remove the helmet. In this way, the wearer is assured that the light source is activated when the helmet is secured in place on his head and deactivated when the helmet is removed.

According to another aspect of the invention, an illuminated safety helmet has a protective liner formed with front and back divided cavities in which front and back diode modules of the illumination system are supported, and a separate outer shell covering the liner provided with front and back lenses supported by the shell in position over the diode cavities through which the diodes can be seen when illuminated. Mounting the diode modules in the front and back cavities of the liner protects them from damage during the manufacture and use of the helmet and mounting the lenses on the outer shell separately from the liner simplifies the manufacture of the helmet by automatically locating the lenses in position over the cavities upon assembling the shell to the liner.

BRIEF DESCRIPTION OF THE DRAWINGS

These and other features, objects and advantages of the present invention will be more fully understood and appreciated by those skilled in the art when considered in connection with the detailed description and accompanying drawings, wherein.

DETAILED DESCRIPTION OF THE PREFERRED EMBODIMENTS

Figure 1:
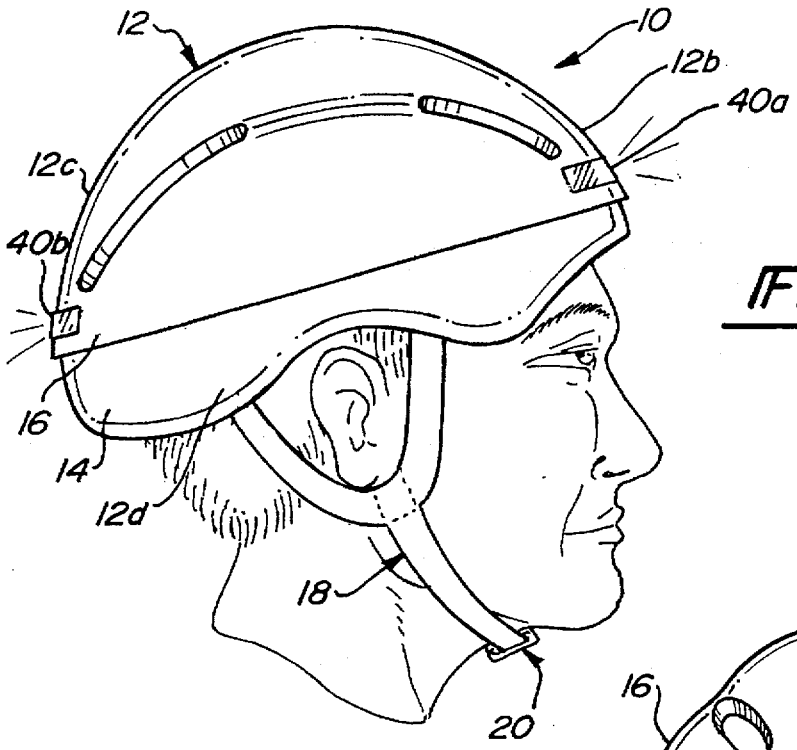
FIG. 1 is a side elevational view of the helmet of the invention shown bering worn by a user.

An illuminated helmet assembly constructed according to a presently preferred embodiment of the invention is shown generally at 10 in the drawings, and comprises a protective helmet 12 having a core 14 and an outer shell 16 of generally conventional design. Core 14 is molded from foamed polystyrene or other suitable energy absorbing material found in conventional safety helmets to protect the user's head upon impact. The outer shell 16 is preferably a thin-walled impact-resistant material, such as molded plastics which serves as a protective covering for the core 14 to protect it against inadvertent damage under low impact conditions such as would occur, for example, if the helmet were dropped or bumped against a harder object. It also serves as a cosmetic covering and can be painted or decorated with high gloss colored coatings.

The helmet 14 defines a generally concave interior surface 12*a* that conforms generally to the shape of the user's head, such that when helmet 12 is placed on the head of the user, the front 12*b*, back 12*c* and opposing left and right sides 12*d* of the helmet 12 cover at least in part the front, back and sides of the user's head, respectively, as is conventional and illustrated in FIG. 1.

Figure 2:
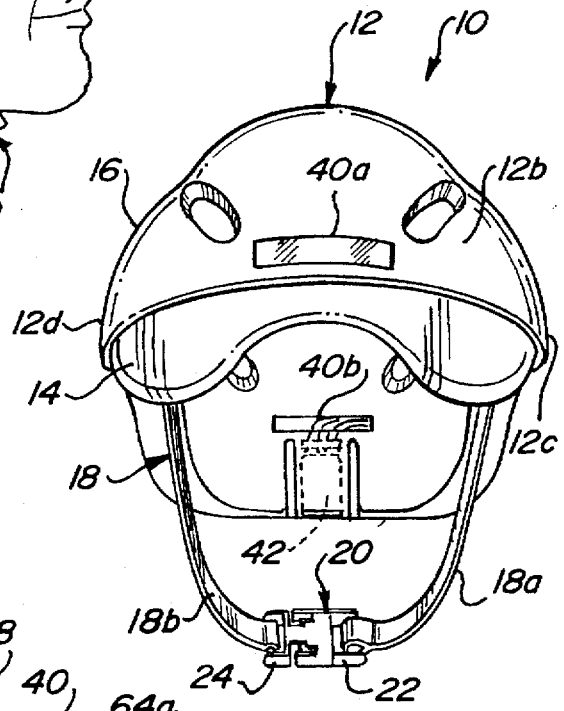
FIG. 2 is a front elevational view of the helmet.

The helmet 12 has a chin strap 18 extendable beneath the chin of the user and secured by a releasable buckle 20 in the manner generally shown in FIGS. 1 and 2. The strap 18 preferably comprises a pair of flexible bands that extend from the opposite sides 12*d* of the helmet 12 to loose or free ends 18*a*, 18*b* thereof. The buckle 20 preferably comprises a pair of mutually engageable female and male snap together connector portions 22, 24 secured in suitable fashion to the respective ends 18*a*, 18*b* of the bands. The female connector portion 22 is preferably a hollow molded plastics component defining a longitudinal channel 26 or predetermined width open at a free receiving end 28 thereof and closed at its opposite end by an end wall 29. A pair of release openings 30 are formed in a side wall of the female portion 22 presenting transverse locking shoulders 32. The male connector portion 24,. is also preferably a molded plastics component that is formed with a longitudinal projection or body 34 flanked on either side by a pair of deflectable locking arms 36. The arms 36 terminate at enlarged heads 37 that are wider than the channel 26 when in the unflexed condition and define transverse locking shoulders 38 engageable with the locking shoulders 32 of the female connector 22.

The assembly construction 10 includes a lighting system 39 comprising a light source 40, a power source 42 and an electrical control circuit 44 connecting the power source 42 to the light source 40.

The light source 40 comprises at least one and preferably a pair of light emitting devices in the preferred form of commercially available light emitting diode (LED) modules 40*a*, 40*b* mounted preferably at the front 12*b* and back 12*c* of the helmet 12, respectively. Commercially available (LED) modules 40*a*, 40*b* may either produce a constant illumination or may provide flashing light from each diode 43. The power source 42 preferably comprises a dry battery cell such as, for example, a standard 9-volt battery having leads 48, 50 of opposite polarity.

Figure 5:
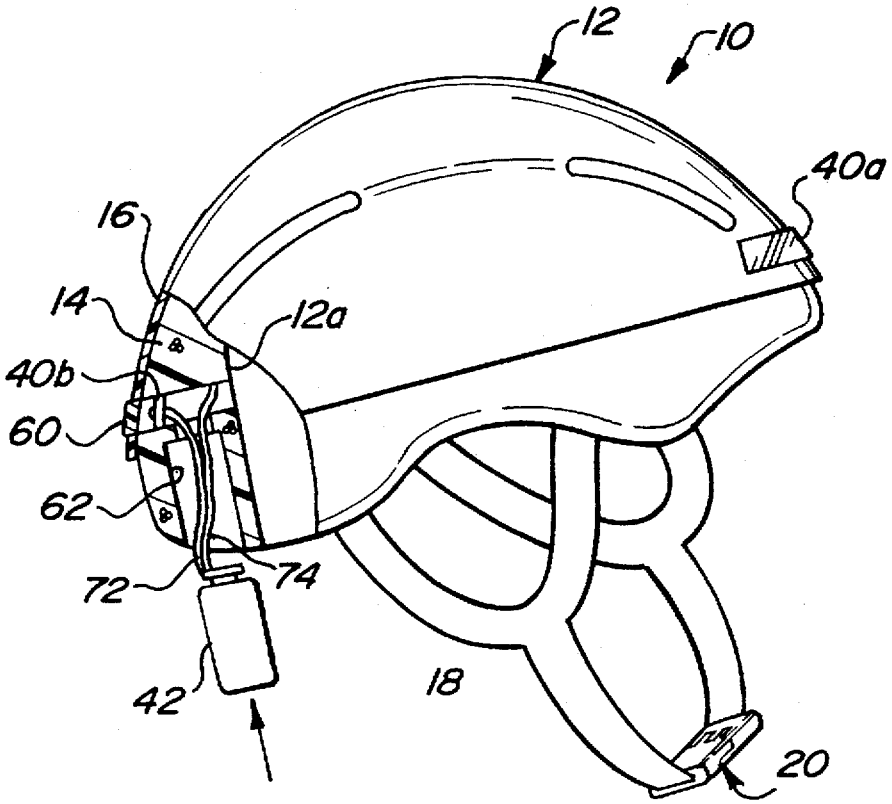
FIG. 5 is a partially broken away side elevational view of the helmet showing features of the battery compartment.
Figure 6:
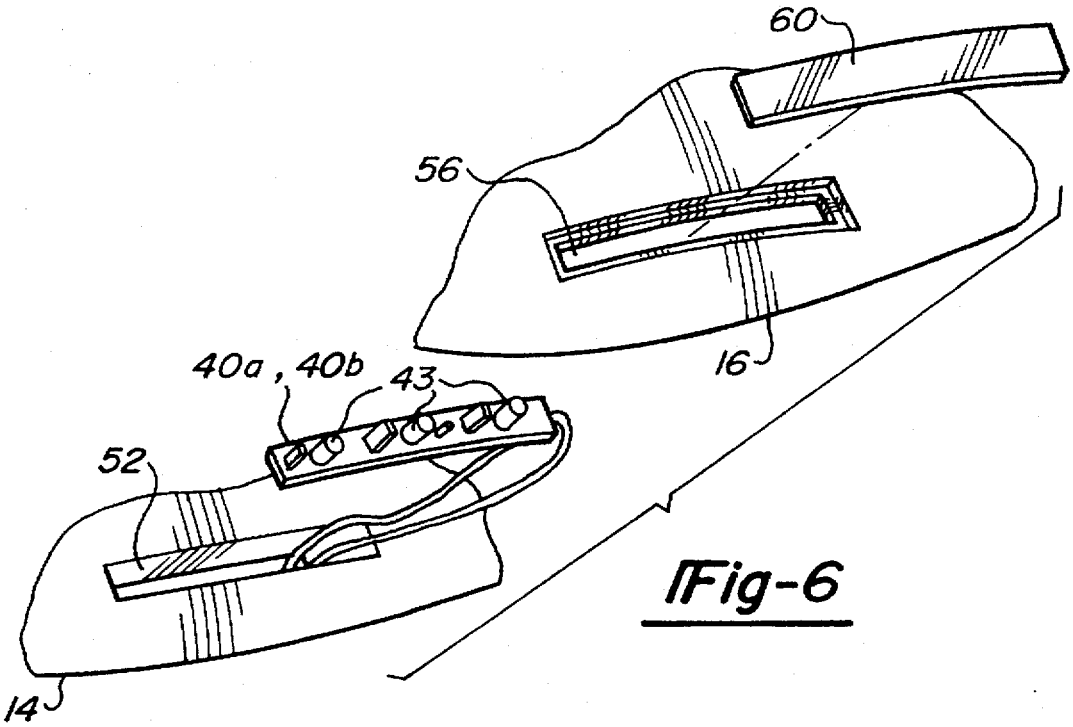
FIG. 6 is an exploded fragmentary perspective view of the helmet.

The diode modules 40*a* and 40*b* are disposed preferably in recessed cavities 52 molded in the core 14 at the front 12*b* and back 12*c* of the helmet, respectively. Mounting the diode modules 40*a*, 40*b* within the cavities 52 protects them from damage during manufacture and use of the helmet. As illustrated in FIG. 6, corresponding openings 56 are provided in the shell 16 and are covered by red lenses 60 affixed to the shell through which the lights 40*a*, 40*b* can be seen. The openings 56 are recessed so that the lenses 60 are generously flush with the outer surface of the shell 16. As illustrated in FIG. 2 and 5, the core 14 includes an additional recess or cavity 62 adjacent the back of the helmet for housing the battery 42. The cavity 62 opens to the bottom to allow the battery 42 to be slid into and out of the cavity and is preferably sized to provide a tight-frictional fit of the battery 42 to hold the battery 42 securely but releasably within the cavity 62.

Figure 3:
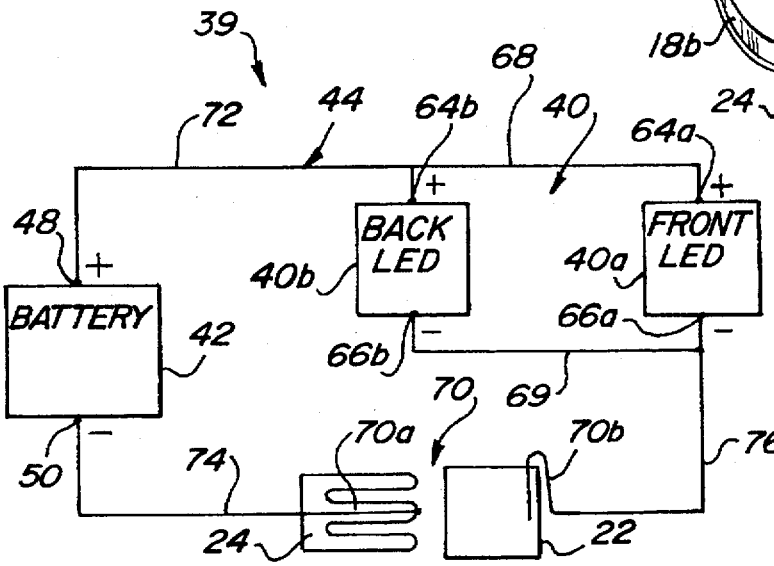
FIGS. 3 and 4 are schematic circuit diagrams of the illumination system showing the diode modules wired in parallel and series, respectively.

As illustrated diagrammatically in FIG. 3, the diode modules 40*a*, 40*b* are provided with input terminals 64*a*, 64*b* and output terminals 66*a*, 66*b*, connected preferably in parallel by wires 68, 69. A first circuit wire 72 connects the positive terminal 48 of the battery 42 to one of the input terminals of the parallel diode modules, which in the illustrated embodiment is the terminal 64*b* of the back module 40*b*. A second circuit wire 74 connects the negative lead 50 of the battery 42 to one side 70*a* of a switch 70, and a third wire 76 connects the output lead of the other module, (i.e., the output terminal 66*a* of the front light module 40*a*) to the other contact side 70*b* of the switch 70. It will appreciated that the switch 70 could be placed anywhere along the circuit where it would operate to open and close the circuit from the battery 42 to the diode modules 40*a*, 40*b*.

Figure 7:
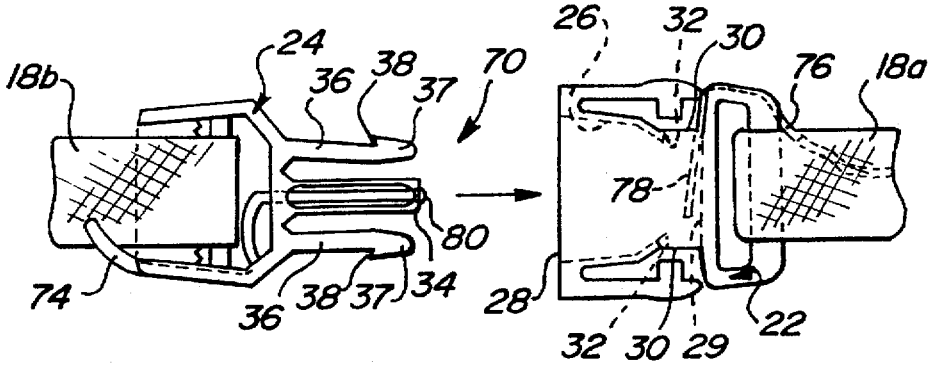
FIGS. 7 and 8 are enlarged fragmentary plan views of the buckle portions of the straps shown in the disengaged and engaged positions, respectively.
Figure 8:
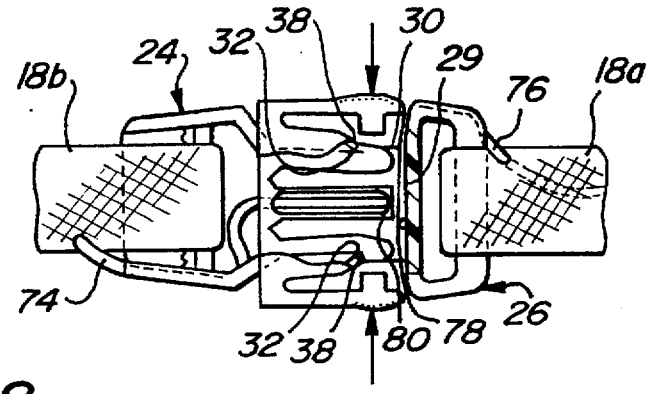

Referring now to FIGS. 7 and 8, the switch 70 comprises a pair of electrical contacts 78, 80 made of an electrically conductive material such as copper that are disposed on the connectors 22, 24 in such way as to engage and disengage with one another when the connectors 22, 24 are buckled and unbuckled, respectively.

The contact 80 is disposed on the leading free end of the body 34 of the male connector 24. As illustrated, the contact 80 may project slightly beyond the end of the body 34 and have a hemispherical bead-like configuration for making point contact with the other contact 78. The contact 78 preferably has a spring leaf construction comprising a resilient strip that is anchored at one end to the connector 22 and projects therefrom into the channel 26 at an outward angle with respect to the end wall 29 to a free end thereof adjacent to but spaced from the end wall 29.

The wires 74, 76 are routed along the chin strap 18 and into the connectors 22, 24 where they are joined with the contacts 78, 80. Preferably, the wires 74, 76 are embedded in the material of the chin strap 18 so as to be concealed from view.

In operation, the helmet 12 is placed on the head of the user in conventional manner and secured releasably in place by extending the body 34 and arms 36 of the connector 34 forcible into the channel 26. This causes the arms 26 to deflect initially inwardly and then return outwardly as the heads 37 align with the openings 30, bringing the locking shoulders 32, 38 of the connectors 22, 24 into confronting locked engagement with one another. Joining the connectors 22, 24 simultaneously brings the contacts 78, 80 into engagement with one another and closes the electrical circuit 44 such that power is directed from the battery 42 to each of the diode modules 40*a*, 40*b*. As illustrated by a comparison of FIGS. 7 and 8, the contact 80 deflects the contact 78 toward the end wall 29. The opposing spring force of the contact 78 maintains the contacts 78, 80 in positive engagement with one another to account for manufacturing tolerances and wear of the connectors 22, 24.

The modules 40*a*, 40*b* are automatically de-energized upon removal of the helmet 12. To remove the helmet, the wearer is required to unbuckle the connectors 22, 24 which operates to separate the contacts 78, 80 (FIG. 7), opening the circuit 44 and discontinuing power from the battery 42 to the modules 40*a*, 40*b*.

Figure 4:
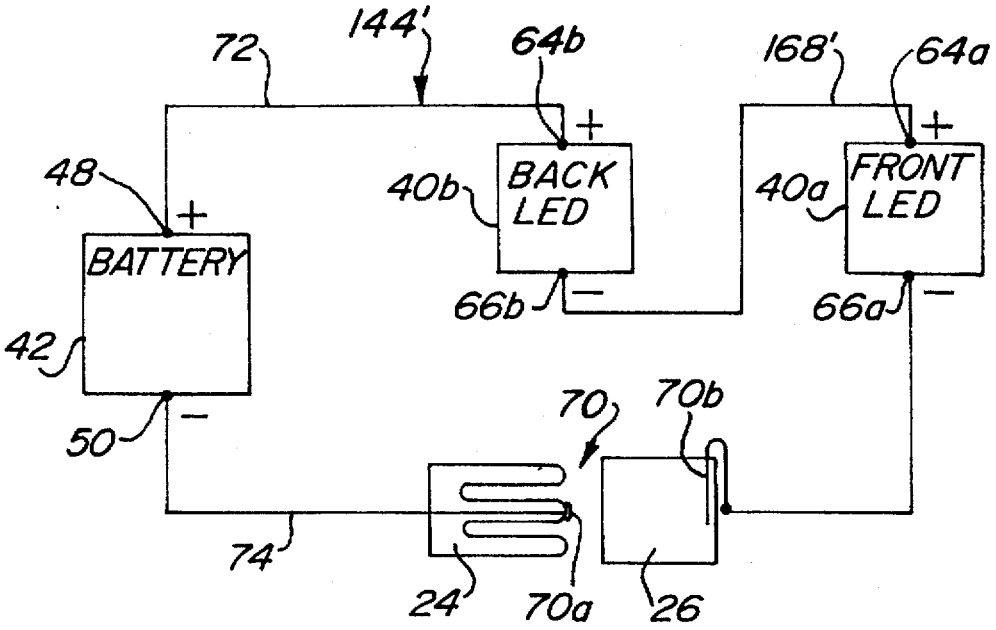

FIG. 4 illustrates an alternative circuit arrangement 144 like that described above except that the diode modules 40*a*, 40*b* are wired in series by wire 168 rather than in parallel. Apart from this difference, the remaining features and operation is identical to that described above and is incorporated herein by reference.

It is to be understood that the foregoing description is of presently preferred embodiments of the invention and is intended to be illustrative rather than definitive thereof. The invention is defined in the appended claims which contemplate any and all embodiments within the scope and spirit of the invention.

We claim:

1. An illuminated safety helmet assembly comprising:

a protective helmet;

a chin strap having releasably engageable buckle portions that when connected operate to secure said helmet releasably to the head of a user and when disconnected enable said helmet to be removed;

a light source supported by said helmet;

a power source; and a control circuit coupling said power source electrically to said light source, said circuit including a switch movable between a closed circuit position in response to the connection of said buckle portions to energize said light source and an open circuit position in response to the disconnection of said buckle portions to de-energize said light source.

2. The illuminated safety helmet assembly of claim 1, said switch including contacts supported by said buckle portions for movement into and out of contacting engagement with the connection and disconnection, respectively, of said buckle portions.

3. The illuminated safety helmet assembly of claim 1, said buckle portions comprising male and female snap together elements slidable into and out of locked engagement with one another.

4. The illuminated safety helmet assembly of claim 3, said female element including a channel having an end wall and said male element including a body having a free end, said contacts being disposed on said end wall and said free end, respectively, and movable into and out of contacting engagement with one another in response to inserting and removing said body fully into and out of locking engagement in said channel.

5. The illuminated safety helmet assembly of claim 1, said battery cell including a pair of leads of opposite polarity, a first wire connecting one of said leads of said battery to a first contact mounted on one of said buckle portions, a second wire connecting the other of said leads of said battery to a corresponding lead of said light source, and at least a third wire connecting another lead of said light source to a second contact mounted on the other of said buckle portions.

6. The illuminated safety helmet assembly of claim 5, said light source including at least a pair of light emitting devices coupled electrically to one another.

7. The illuminated safety helmet assembly of claim 5, said light source comprising at least a pair of light emitting diodes connected in parallel.

8. The illuminated safety helmet assembly of claim 5, said light source comprising at least a pair of light emitting diodes connected in series.

9. The illuminated safety helmet assembly of claim 1, said helmet including a crushable energy absorbing core and an outer shell, said shell and said core formed with a plurality of cavities therein, said battery cell and said light source being disposed within said cavities.

10. The illuminated safety helmet assembly of claim 9, said helmet having front and back regions and said light source including at least two light emitting devices, one of said cavities being provided at said front region of said helmet and housing one of said light emitting devices and another of said cavities being provided at said back region of said helmet and housing the other of said light emitting devices.

11. The illuminated safety helmet assembly of claim 9, said cavity associated with said battery being open enabling said battery to be slid into and out of said associated cavity and being of such size relative to said battery to frictionally engage and hold said battery securely but releasably within said associated cavity.

12. An illuminated safety helmet construction, comprising:

a protective helmet having a plurality of cavities formed therein, a first of said cavities being provided at a front of said helmet and a second of said cavities being provided at a back of said helmet;

a chin strap extending from said helmet having releasably engageable snap-together buckle portions;

a pair of light emitting diode modules coupled electrically to one another, one of said light modules being disposed in said first cavity at said front of said helmet and the other of said light modules being disposed in said second cavity at said back of said helmet;

a battery cell disposed in another of said cavities;

a circuit coupling said battery cell electrically to said light modules, said circuit including a pair of electrical contacts disposed in said buckle portions, said contacts operating as a switch to close the circuit when said buckle portions are connected to energize said light modules and to open the circuit when said buckle portions are disconnected to de-energize said light modules.

13. An illuminated safety helmet comprising:

an energy-absorbing liner having front and back cavities formed therein;

front and back light emitting diode modules supported in said front and back cavities, respectively of said liner;

an electrical power circuit mounted on said liner and coupled to said front and back light emitting diode modules, said electrical power circuit including a battery and an operable on and off switch operably positioned between said light emitting diode modules and said battery for opening said power circuit from said battery and deenergizing said light emitting diode modules when in the off position, said switch automatically and simultaneously responsive to installation and removal of said helmet from the head of a user to energize and deenergize, respectively said light emitting diode modules, such that upon complete installation of said helmet on the head of the user, said light emitting diodes are energized; and an outer shell secured to said liner having front and back lenses supported by said shell in covering position over said cavities and through which light emitted from said light emitting diode modules can be seen when energized by said electrical power circuit.

14. An illuminated safety helmet comprising:

an energy-absorbing liner having front and back cavities formed therein;

front and back light emitting diode modules supported in said front and back cavities, respectively of said liner;

an electrical power circuit mounted on said liner and coupled to said front and back light emitting diode modules, said electrical power circuit including a battery and an operable on and off switch; and an outer shell secured to said liner having front and back lenses supported by said shell in covering position over said cavities and through which light emitted from said light emitting diode modules can be seen when energized by said electrical power circuit;

said helmet further including a chin strap and a buckle having connector portions thereof joinable and releasable from one another for securing and releasing, respectively, said chin strap to the head of a user, and said on/off switch including a pair of electrical contacts mounted on said connector portions and engageable with one another in response to joining said connector portions to energize said light emitting diode modules and further disengageable from one another in response to releasing said connector portions to de-energize said light emitting diode modules.

* * * * *